US005337888A

United States Patent [19]

Morrison

[11] Patent Number: 5,337,888

[45] Date of Patent: Aug. 16, 1994

[54] CONTACT LENS CASE

[76] Inventor: Robert J. Morrison, Morrison Associates, Green and Division Sts., Harrisburg, Pa. 17105

[21] Appl. No.: 114,155

[22] Filed: Sep. 1, 1993

[51] Int. Cl.[5] ..... B65D 85/38

[52] U.S. Cl. ..... 206/5.1; 206/459.1

[58] Field of Search ..... 206/5.1, 210, 459.1, 206/459.5; 294/1.2

[56] References Cited

U.S. PATENT DOCUMENTS

| | | | |
|---|---|---|---|
| 4,415,076 | 11/1983 | Campbell | 206/5.1 |
| 4,543,882 | 10/1985 | Ryder et al. | 206/5.1 |
| 4,545,479 | 10/1985 | Figari | 206/5.1 |
| 4,623,249 | 11/1986 | Grant | 206/5.1 |
| 4,691,820 | 9/1987 | Martinez | 206/5.1 |
| 5,054,610 | 10/1991 | Ajello | 206/5.1 |
| 5,086,913 | 2/1992 | Camm et al. | 206/5.1 |

FOREIGN PATENT DOCUMENTS

| | | | |
|---|---|---|---|
| 2100878 | 1/1983 | United Kingdom | 206/5.1 |

*Primary Examiner*—Jimmy G. Foster
*Attorney, Agent, or Firm*—Robert A. Green

[57] ABSTRACT

The package of the invention includes cup-shaped bottom and a cover sealed thereto, both being transparent and of a rigid material. A storage solution and a contact lens are contained within the package. The package includes means for determining the diameter of the lens therein and since it is transparent, the lens can be visually examined for defects.

7 Claims, 1 Drawing Sheet

CONTACT LENS CASE

BACKGROUND OF THE INVENTION

At the present time, relatively inexpensive disposable contact lenses have become available through doctors, opticians and even through mail-order houses. Such lenses come in small packages and they are in effect dispensed without having the parameters of the lenses checked and inspected by a doctor or other capable professional. Contact lenses should be inspected so that the diameter, power and base curve can be verified and the edges should be inspected to see that they are not irregular or damaged. The overall lens quality should be checked and it should be determined that there are no bacteria, fungi or other debris on the lens or in the case.

At the present time such disposable, pre-packaged lenses are in such packages that they cannot be inspected and the wearer cannot tell if he has a perfect lens or if there is any problem with the lens which prohibit his wearing the lens.

SUMMARY OF THE INVENTION

The problems set forth above are solved by the present invention which comprises a transparent package for a lens through which a doctor can see the lens and can examine the lens by eye or by instrument to determine that none of the problems set forth above are present. In addition, the package contains measuring means for determining and verifying the diameter and other parameters of the lens.

DESCRIPTION OF THE INVENTION

Figure 1:
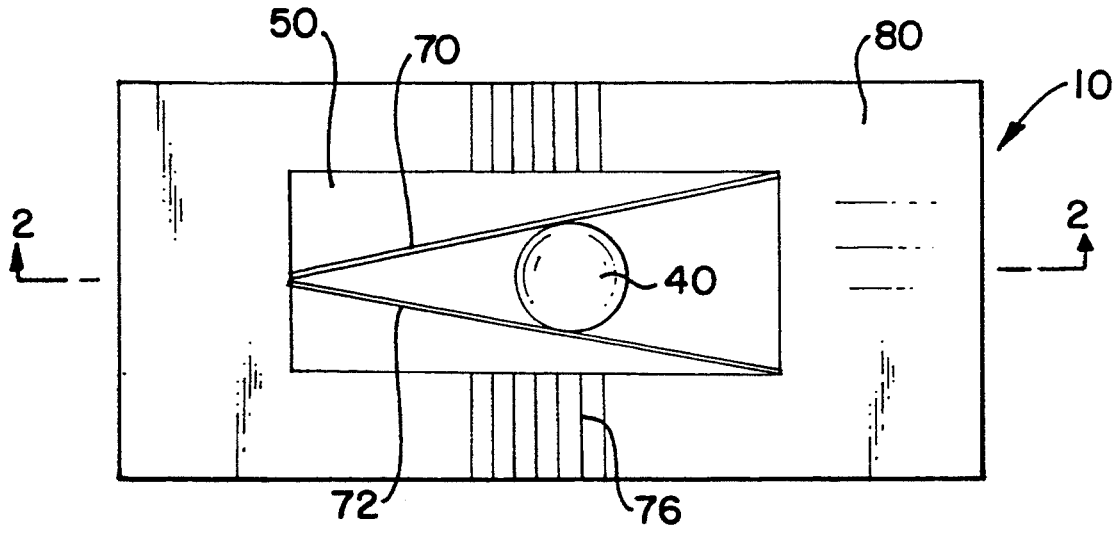
FIG. 1 is a plan view of a packaged lens embodying the invention.
Figure 2:
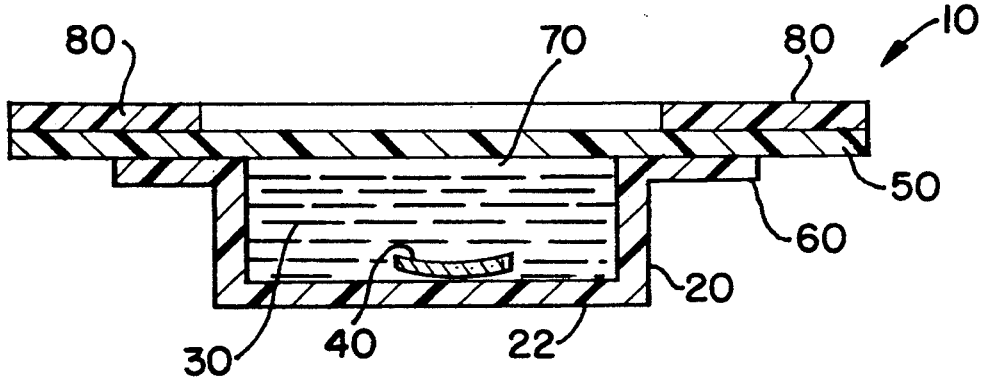
FIG. 2 is a sectional view along the lines 2—2 in FIG.

A contact lens package 10 embodying the invention includes a cup-shaped bottom portion 20 which contains a saline solution 30, or the like, and a contact lens 40. The cup-shaped bottom portion is made of a rigid transparent plastic and includes a bottom wall 22 which is preferably flat. The package 10 also includes a cover 50, preferably flat and secured, watertight, to a lip or rim 60 formed on the bottom portion 20 of the package. The cover 50 is also made of a transparent plastic, preferably rigid, so that a doctor can look through the cover into the bottom portion and can see a contact lens held therein. The doctor can also look through the bottom wall 22.

The bottom portion 20 of the package is provided with a V-shaped chamber in which the lens 40 is positioned. The V-shaped chamber comprises two side walls 70 and 72 which are joined, or placed close together, at one end and spread apart so that they are spaced apart at their opposite ends and present a V-shaped appearance. The contact lens 40 is positioned between the two walls 70 and 72 and it is positioned close to the joined ends of the walls whereby the diameter of the lens can be determined visually by reference to markings 76 in tenths of a millimeter on the cover 50 of the package. The markings 76 might also be otherwise located, for example on the bottom portion adjacent to the V-shaped chamber.

With the package of the invention, a doctor can readily determine the diameter of a lens and with the eye or an instrument such as a microscope or magnifying lens, he can visually examine the edge of the lens and the body of the lens for any damage or irregularities which would prohibit wear or result in eye irritation or disturbance. In addition, the power of the lens can be readily determined, since the index of refraction of the storage solution and the case are known, a table of powers could be readily worked up for this purpose. The lens can also be examined visually through the bottom wall of the cup-shaped bottom portion 20.

A label 80 or the like can be secured to the outer surface of the cover 50, preferably positioned so as not to obscure the inside of the package from being viewed through the cover. The label could list parameters and can allow notation that the lens has been inspected and by whom.

What is claimed is:

1. A package for a contact lens comprising a cup-shaped bottom portion having a transparent bottom wall, a transparent cover secured to said cup-shaped bottom portion, a protective storage solution in said cup-shaped bottom portion, a contact lens in said solution, wall means in said package for providing a measurement of the diameter of said lens and of the diameters of a plurality of different contact lenses while in said package, and marking on said package in operative relation with said wall means to provide a dimensional indication of the diameter of a lens inside said package.

said lens inside said package being inspectable through said cover and through said transparent bottom wall to determine its characteristics and general condition.

2. The package defined in claim 1 wherein said cover is flat and said cup-shaped bottom portion is transparent and has a flat bottom wall.

3. The package defined in claim 1 wherein said cover and said cup-shaped bottom portion are made of a rigid transparent plastic.

4. The package defined in claim 1 wherein said means includes a pair of walls disposed close together at one end and spaced apart at the other with the lens held between the walls, and markings on said package showing the diameter of the lens for a particular position of the lens between the walls.

5. The package defined in claim 4 wherein said markings are positioned on said cover of said package.

6. A package for a contact lens comprising a transparent cup-shaped bottom portion having a flat base, a transparent cover secured to said cup-shaped bottom portion, a protective storage solution in said cup-shaped bottom portion, a contact lens in said solution, and means in said package for providing a measurement of the diameter of said lens while in said package, said lens being inspectable through said cover and through said bottom portion to determine its characterstics and general condition, and said means for providing a measurement of the diameter of said lens including a pair of walls disposed close together at one end and spaced apart at the other with the lens held between the walls, and markings on said package showing the diameter of the lens for a particular position of the lens between the walls.

7. The package defined in claim 6 wherein said markings are positioned on said cover of said package.

* * * * *